US006066006A

United States Patent [19]

Shaw

[11] Patent Number: 6,066,006

[45] Date of Patent: May 23, 2000

[54] INJECTION MOLDED INSULATOR

[75] Inventor: Kevin Gerard Shaw, Dallas, Tex.

[73] Assignee: Lucent Technologies, Inc., Murray Hill, N.J.

[21] Appl. No.: 09/187,929

[22] Filed: Nov. 6, 1998

[51] Int. Cl.[7] ..... H01R 13/405

[52] U.S. Cl. ..... 439/736; 439/212

[58] Field of Search ..... 439/736, 212

[56] References Cited

U.S. PATENT DOCUMENTS 5,213,518 5/1993 Weidler ..... 439/212

5,857,259 1/1999 Johnston ..... 439/736

*Primary Examiner*—Gary F. Paumen

*Attorney, Agent, or Firm*—Locke Liddell & Sapp LLP

[57] ABSTRACT

An electrical insulator for providing insulation between electrical contacts includes an injection molded housing. The housing includes a plurality of apertures adapted to receive the electrical contacts. Electrical contacts are inserted into the apertures and are installed utilizing ultrasonic welding.

1 Claim, 2 Drawing Sheets

INJECTION MOLDED INSULATOR

BACKGROUND OF THE INVENTION

Electrical insulators are utilized for providing insulation between electrical contacts. Such insulators may be mounted to printed circuit boards which are connected to bus bars. The insulators provide insulation between the bars and/or electronic components adjacent to the bus bars. Typically, such insulators are machined. Machined insulators require large clearance holes to allow for tooling. These clearance holes can sacrifice the integrity of the insulating materials comprising the insulator. As a result, arcing may occur between electrical contacts located within the insulator causing damage to electronic components as well as creating safety hazards.

A need has thus arisen for an improved electrical insulator having improved integrity, which can be manufactured in intricate shapes, and which is economical to manufacture.

SUMMARY OF THE INVENTION

In accordance with the present invention, an electrical insulator for providing insulation between electrical contacts is provided. The insulator includes an injection molded housing. The housing includes a plurality of apertures adapted to receive the electrical contacts. Electrical contacts are inserted into the apertures and are installed utilizing ultrasonic welding.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
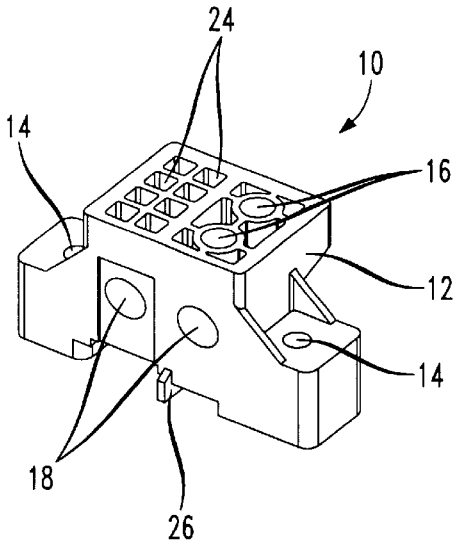
FIG. 1 is a top perspective view of the present electrical insulator.
Figure 2:
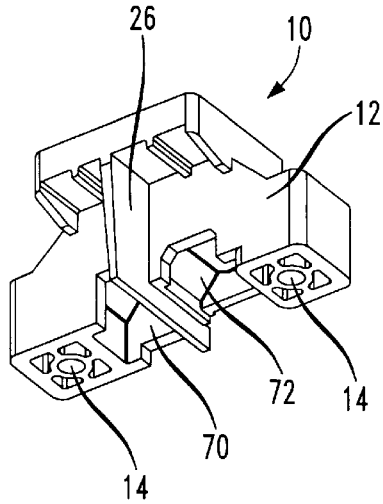
FIG. 2 is a bottom perspective view of the present electrical insulator.
Figure 3:
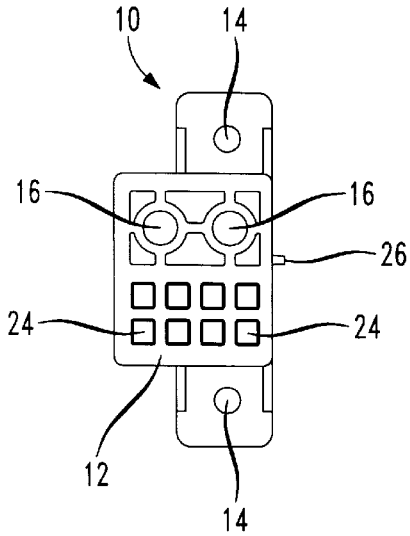
FIG. 3 is a top plan view of the present electrical insulator.

Referring to FIGS. 1–3, the present electrical insulator is illustrated, and is generally identified by the numeral 10. Electrical insulator 10 includes a housing 12. Housing 12 is adapted to be mounted to a printed circuit board (FIG. 4) utilizing apertures 14. Housing 12 further includes apertures 16 and 18 which receive electrical contacts for mating with a bus bar or other electrical components as will be discussed with respect to FIG. 4. Housing 12 may be of any desired shape.

An important aspect of the present invention is that housing 12 is injection molded including the formation of apertures 14, 16, and 18. As a result of injection molding, insulator 10 requires no secondary machining operations to sacrifice the integrity of insulator 10. Areas between contacts inserted into apertures 16 and 18 of housing 12 are precisely dimensioned to prevent arcing which may occur between adjacent contacts within previously used insulators.

Housing 12 further includes apertures 24. Apertures 24 are utilized to remove material from housing 12 in order to maintain a standard housing wall thickness and thereby prevent insulator 10 from warping.

Housing 12 further includes an integrally molded barrier 26. Barrier 26 functions to provide physical separation and insulation between bus bars as will be discussed with respect to FIG. 4.

Housing 12 may be molded from MAKROLON Resin 6485 manufactured and sold by Bayer Corporation, Polymer Division. Such material is Underwriter Laboratory approved and rated 94V0. Housing 12 may be molded, for example, in an injection molding machine having a tonnage of 100 and barrel size of 6 ounces. Processing cycle time may range from 35 to 40 seconds with a standard injection time of 5.8 seconds, injection hold time of 12 seconds and cooling time of 13.2 seconds. Nozzle temperatures range in the area of about 485° F. Injection molding pressures are in the range of 800 to 1,000 psi, with a hold pressure of 300 psi and a back pressure of 100 psi. The shot size is 1½ ounces. The dryer temperature is about 225° F. with an approximate drying time of 3 to 4 hours.

Figure 4:
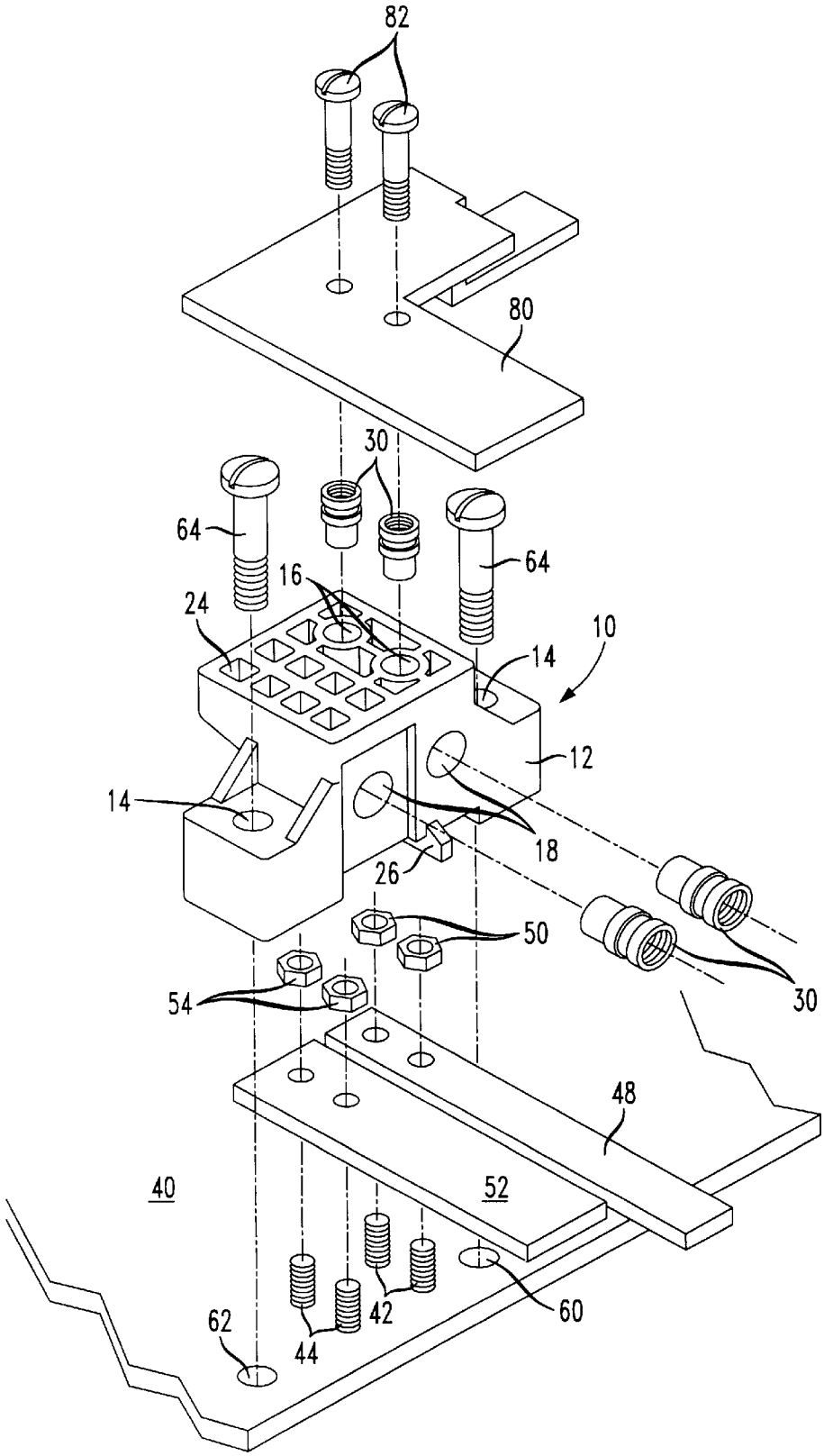
FIG. 4 is an exploded perspective view of the present electrical insulator, circuit board, and bus bars.

FIG. 4 illustrates contacts 30 utilized with the present insulator which may include, for example, threaded inserts for plastic, manufactured and sold by Emhart Fastening Teknologies under the trademark "DODGE", for example, Part Nos. 6035-06BR150 and 6041-3BR375. Such inserts can be installed within housing 12 utilizing ultrasonic welding, hot or cold press-in, mold-in, or self-threading. Ultrasonic welding provides for material of housing 12 to be displaced around the insert to provide for increased pull-out strength. To accommodate the inserted contacts, apertures 16 and 18 include a draft angle to provide material for the ultrasonic weld around the inserted contact.

Referring now to FIG. 4, an exploded perspective view illustrating installation of the present insulator 10 on a circuit board together with associated bus bars will now be described. Insulator 10 may be utilized with a printed circuit board 40, a portion of which is illustrated in FIG. 4. Printed circuit board 40 includes a first pair of stakes 42 and a second pair of stakes 44. Stakes 42 and 44 are electrically connected to printed circuit board 40. Stakes 42 receive a bus bar 48. Bus bar 48 is interconnected to printed circuit board 40 utilizing fastening nuts 50. Stakes 44 receive a bus bar 52. Bus bar 52 is interconnected to printed circuit board 40 utilizing fastening nuts 54. Bus bars 48 and 52 are interconnected to other circuitry (not shown) and which is not located on printed circuit board 40.

Printed circuit board 40 includes apertures 60 and 62. Insulator 10 is mounted to printed circuit board 40 using fasteners 64 which are inserted through apertures 14 of housing 12 for mating with apertures 60 and 62 of printed circuit board 40. Fastening nuts 50 and 54 are disposed within cavities 70 and 72 (FIG. 2) of housing 12. Barrier 26 provides insulation between bus bars 48 and 52, and extends to the surface of printed circuit board 40 between those portions of bus bars 48 and 62 which are in contact with the surface of printed circuit board 40.

Contacts 30 are inserted into apertures 16 of housing 12, and are utilized for fastening a bus bar 80 to the top surface of housing 12. Fasteners 82 are received within contacts 30 for mounting bus bar 80 to insulator 10. Bus bar 80 is attached to the surface of printed circuit board 40 and received other electrical components. It therefore can be seen that insulator 10 provides insulation between bus bars 48, 52, and 80.

Contacts 30 are also received within apertures 18 of housing 12. Contacts 30 within apertures 18 receive fasteners for mounting additional circuit components (not shown) such as, for example, brackets of adjacent printed circuit boards or other electrical components.

The ability to control the manufacturing process of insulator 10 through injection molding ensures that contacts 30 within apertures 16 and 18 do not contact each other within housing 12 to thereby prevent electrical shorting.

It therefore can be seen that the present invention provides for an electrical insulator having improved insulative qualities, improved integrity, having variable shapes, and which results in an insulator that is economic to manufacture over machined insulators.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. An electrical assembly comprising:

a printed circuit board;

a first bus bar mounted to said printed circuit board;

a second bus bar mounted to said printed circuit board, said second bus bar being spaced apart from and adjacent to said first bus bar;

an electrical insulator mounted to said printed circuit board adjacent to said first and second bus bars, said insulator including an injected molded housing, said housing including a top surface, a bottom surface, and first and second side surfaces, said bottom surface including a projection injected molded with said housing, said projection being disposed between said first and second bus bars for providing insulation between said first and second bus bars, said top surface and one of said side surfaces including a plurality of apertures extending a predetermined distance into said housing;

a plurality of electrical fasteners mounted within said housing apertures; and a third bus bar mounted to ones of said electrical fasteners disposed within said housing, such that said insulator provides electrical insulation between first, second, and third said bus bars and said fasteners.

* * * * *